US010056724B2

(12) United States Patent
Choo et al.

(10) Patent No.: US 10,056,724 B2
(45) Date of Patent: Aug. 21, 2018

(54) CONNECTOR ASSEMBLY HAVING TWO CONNECTOR HOUSINGS COUPLED TO A COVER IN A SLIDING MANNER

(71) Applicants: Hyundai Motor Company, Seoul (KR); KIA Motors Corporation, Seoul (KR); Tyco Electronics AMP Korea Co., Ltd., Gyeongsan-si, Gyeongsangbuk-do (KR)

(72) Inventors: Sung Kwan Choo, Hwaseong-si (KR); Jong Pil Choi, Hwaseong-si (KR); Kyu Taek Jung, Daegu (KR); Keun Taek Lim, Gyeongsan-si (KR); Keun Sung Song, Suwon-si (KR)

(73) Assignees: Hyundai Motor Company, Seoul (KR); Kia Motors Corporation, Seoul (KR); Tyco Electronics AMP Korea CO., Ltd., Gyeongsan-si (KR)

( * ) Notice: Subject to any disclaimer, the term of this patent is extended or adjusted under 35 U.S.C. 154(b) by 0 days.

(21) Appl. No.: 15/493,709

(22) Filed: Apr. 21, 2017

(65) Prior Publication Data

US 2018/0175571 A1 Jun. 21, 2018

(30) Foreign Application Priority Data

Dec. 20, 2016 (KR) ..... 10-2016-0174532

(51) Int. Cl.
*H01R 25/00* (2006.01)
*H01R 13/62* (2006.01)
(Continued)

(52) U.S. Cl.
CPC ..... *H01R 25/162* (2013.01); *H01R 13/514* (2013.01); *H01R 13/518* (2013.01); *H01R 13/631* (2013.01); *H01R 25/14* (2013.01)

(58) Field of Classification Search
CPC .. H01R 9/2608; H01R 9/2691; H01R 13/514; H01R 13/518; H01R 13/516;
(Continued)

(56) References Cited

U.S. PATENT DOCUMENTS 3,588,784 A * 6/1971 Kunkle ..... H01R 13/631 439/379
4,897,041 A * 1/1990 Heiney ..... H01R 23/661 439/404
(Continued)

FOREIGN PATENT DOCUMENTS

JP H08-321348 A 12/1996
JP H11-214064 A 8/1999
(Continued)

*Primary Examiner* — Chandrika Prasad
(74) *Attorney, Agent, or Firm* — Brinks Gilson & Lione

(57) ABSTRACT

A joint connector assembly is disclosed. The joint connector assembly includes a first unit connector housing having a predetermined number of first terminal holes in a predetermined pattern, a second unit connector housing connected to the first unit connector housing and having a predetermined number of second terminal holes in a predetermined pattern, and a sliding cover to allow the first unit connector housing and the second unit connector housing to be coupled to the sliding cover in a sliding manner.

13 Claims, 8 Drawing Sheets

(51) Int. Cl.

| | |
|---|---|
| ***H01R 25/16*** | (2006.01) |
| ***H01R 13/518*** | (2006.01) |
| ***H01R 13/631*** | (2006.01) |
| ***H01R 13/514*** | (2006.01) |
| ***H01R 25/14*** | (2006.01) |

(58) Field of Classification Search
CPC ..... H01R 13/631; H01R 25/14; H01R 25/00; H01R 25/142; H01R 25/162
USPC ..... 439/121, 122, 367, 157
See application file for complete search history.

(56) References Cited

U.S. PATENT DOCUMENTS

| | | | | | |
|---|---|---|---|---|---|
| 5,122,077 | A * | 6/1992 | Maejima | H01R 13/514 | 439/398 |
| 5,183,408 | A * | 2/1993 | Hatagishi | H01R 13/62 | 439/142 |
| 5,885,109 | A * | 3/1999 | Lee | H01R 13/514 | 439/131 |
| 6,155,850 | A * | 12/2000 | Martin | H01R 13/62911 | 439/157 |
| 6,343,960 | B1 * | 2/2002 | Sato | H01R 13/514 | 439/660 |
| 6,905,347 | B2 * | 6/2005 | Kobayashi | B60R 16/0239 | 439/76.2 |
| 7,075,021 | B2 * | 7/2006 | Rowe | H01H 1/5855 | 174/68.2 |
| 9,502,812 | B2 * | 11/2016 | Akagi | H01R 13/506 | |
| 2006/0068627 | A1 * | 3/2006 | Matsunaga | H01R 12/83 | 439/331 |
| 2009/0311918 | A1 | 12/2009 | Martin | | |
| 2010/0254660 | A1 * | 10/2010 | Bailey | H01R 13/514 | 385/75 |
| 2016/0118742 | A1 * | 4/2016 | Akagi | H01R 13/506 | 439/660 |

FOREIGN PATENT DOCUMENTS

| | | | |
|---|---|---|---|
| JP | 2000-277216 | A | 10/2000 |
| JP | 2001-351721 | A | 12/2001 |
| JP | 2002-033154 | A | 1/2002 |
| JP | 2002-134199 | A | 5/2002 |
| KR | 10-2014-0107070 | A | 9/2014 |

* cited by examiner

CONNECTOR ASSEMBLY HAVING TWO CONNECTOR HOUSINGS COUPLED TO A COVER IN A SLIDING MANNER

CROSS-REFERENCE TO RELATED APPLICATION

This application claims the priority to and the benefit of Korean Patent Application No. 10-2016-0174532, filed on Dec. 20, 2016, which is hereby incorporated by reference in its entirety.

FIELD

The present disclosure relates to a joint connector assembly.

BACKGROUND

The statements in this section merely provide background information related to the present disclosure and may not constitute prior art.

In general, a joint connector includes a bus bar provided therein, to which a plurality of terminal pins is connected, and functions to divide current from a single circuit into a plurality of circuits or to collect current from a plurality of circuits into a single circuit.

The number of terminal pins of the joint connector is determined depending on the circuit configuration. Therefore, if the number of circuits is increased, a joint connector having a different configuration capable of handling the increased number of circuits must be produced. For instance, if the number of circuits exceeds the capacity of a 16-pin connector while it is in use, a 30-pin connector must be produced and employed. In other words, depending on the change (i.e. increase or decrease) in the number of circuits in use, the development of connectors suitable for the change must be repeatedly performed.

The joint connector, which is developed in consideration of the number of circuits, has advantages in that connection with the circuits is easy and in that it is harmonious with the circuits because the number of terminal pins is the same as the number of circuits.

However, the development of joint connectors having respectively different numbers of terminal pins causes unnecessary increase in the number of types of joint connectors, degradation of contact reliability, and increase in the burden of quality control processes due to the increase in the number of types of joint connectors.

SUMMARY

The present disclosure provides a joint connector assembly that is capable of being easily modified corresponding to an increase in the number of circuits merely by connecting a plurality of unit connector housings, each having a predetermined number of terminal holes therein, to each other in a sliding cover, thereby inhibiting an unnecessary increase in the number of types of joint connectors and increased development costs.

Additional advantages, objects, and features of the present disclosure will be set forth in part in the description which follows and in part will become apparent to those having ordinary skill in the art upon examination of the following or may be learned from practice of the present disclosure.

The objectives and other advantages of the present disclosure may be realized and attained by the structure particularly pointed out in the written description and the appended drawings.

The present disclosure provides a joint connector assembly that includes: a first unit connector housing having a predetermined number of first terminal holes formed therethrough in a predetermined pattern, a second unit connector housing configured to be connected to the first unit connector housing and having a predetermined number of second terminal holes formed therethrough in a predetermined pattern, and a sliding cover configured to allow the first unit connector housing and the second unit connector housing to be coupled to the sliding cover in a sliding manner.

The number of first terminal holes in the first unit connector housing may be different from the number of second terminal holes in the second unit connector housing.

The first unit connector housing and the second unit connector housing may have the same shape as each other.

The joint connector assembly may further include fastening members provided at lateral surfaces of the first unit connector housing and the second unit connector housing that are configured to contact to each other when the first unit connector housing and the second unit connector housing are connected to each other.

The fastening members may include a first fastening block protruding from a lateral surface of any one of the first unit connector housing and the second unit connector housing, and a first fastening recess formed in a lateral surface of a remaining one of the first unit connector housing and the second unit connector housing, the first fastening recess configured to receive the first fastening block therein so as to be engaged with the first fastening block.

The fastening members may further include a second fastening block provided so as to be aligned with the first fastening recess, and a second fastening recess formed so as to be aligned with the first fastening block and configured to receive the second fastening block therein so as to be engaged with the second fastening block.

The first fastening block and the first fastening recess may be coupled to each other in a sliding manner, or the second fastening block and the second fastening recess may be coupled to each other in a sliding manner.

Engagement between the first fastening block and the first fastening recess or engagement between the second fastening block and the second fastening recess may be achieved by sliding movement in one direction and may be released by sliding movement in an opposite direction.

The fastening members may further include a coupling recess formed in the first fastening block in a direction in which the first fastening block is coupled to the first fastening recess in the sliding manner, and a coupling protrusion protruding from the first fastening recess toward the coupling recess so as to interlock with the coupling recess.

The first fastening block and the first fastening recess may be coupled to each other in a press-fit manner, or the second fastening block and the second fastening recess may be coupled to each other in a press-fit manner.

In one form, the first unit connector housing or the second unit connector housing may include a joint bus bar for connecting terminals provided in the first terminal holes to each other or terminals provided in the second terminal holes to each other in a predetermined pattern, and a bus bar recess formed in a rear surface of the first unit connector housing or the second unit connector housing and configured to receive the joint bus bar therein.

In another form, the sliding cover may have a plurality of inspection holes formed in a rear surface thereof so as to permit inspection of a circuit pattern of the joint bus bar when engagement between the first unit connector housing and the second unit connector housing has been completed.

The sliding cover may be provided with a protruding portion at an inner rear surface thereof, the protruding portion configured to interlock with the first unit connector housing or the second unit connector housing so as to inhibit or prevent the first unit connector housing or the second unit connector housing from being separated from the sliding cover.

The sliding cover may be provided with a resilient portion configured to resiliently support the protruding portion so as to release interlocking engagement between the protruding portion and the first unit connector housing or the second unit connector housing when the first unit connector housing or the second unit connector housing is removed from the sliding cover.

It is to be understood that both the foregoing general description and the following detailed description of the present disclosure are exemplary and explanatory and are intended to provide further explanation of the present disclosure.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
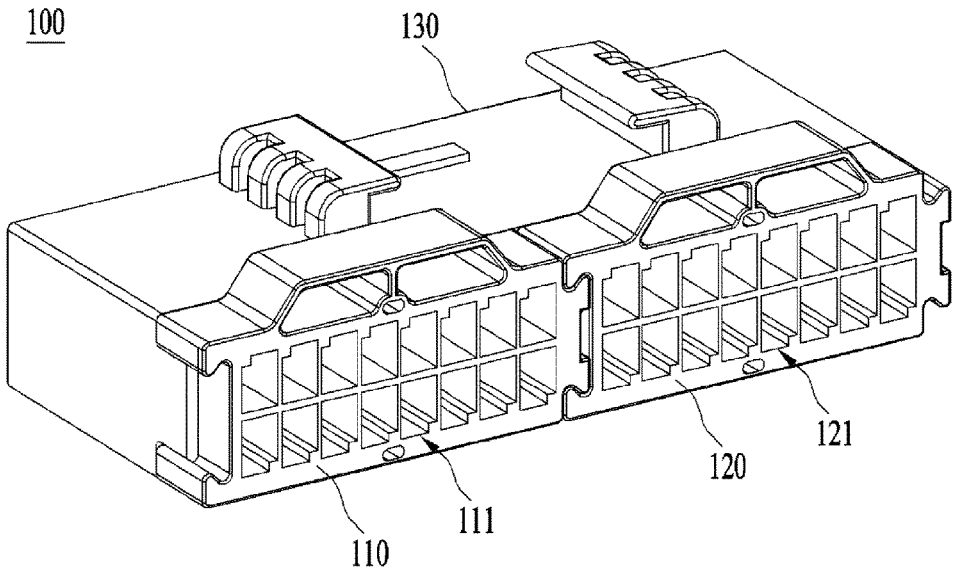
FIG. 1 is a perspective view illustrating a joint connector assembly in the state in which unit connector housings and a sliding cover are coupled to each other.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Before explaining forms of the present disclosure, it is to be understood that the phraseology and terminology used in the following specification and appended claims should not be construed as being limited to general and dictionary meanings but should be construed as having meanings and concepts based on the spirit of the present disclosure on the basis of the principle that the inventor is permitted to define appropriate terms for the best explanation. The forms described in the following specification and shown in the accompanying drawings are illustrative only and are not intended to represent all aspects of the present disclosure, and thus it is to be understood that various equivalents and modifications can be made without departing from the spirit of the present disclosure.

Figure 2A:
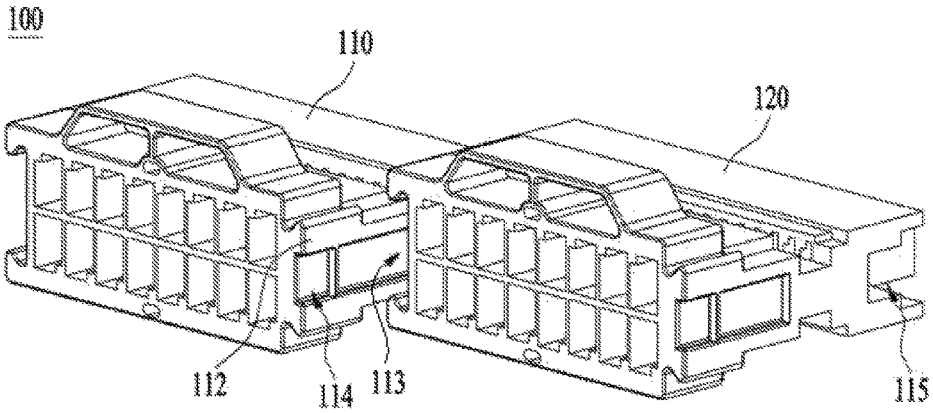
FIGS. 2A-2B are perspective views illustrating the process in which the unit connector housings depicted in FIG. 1 are coupled to each other when viewed from the front thereof.
Figure 2B:
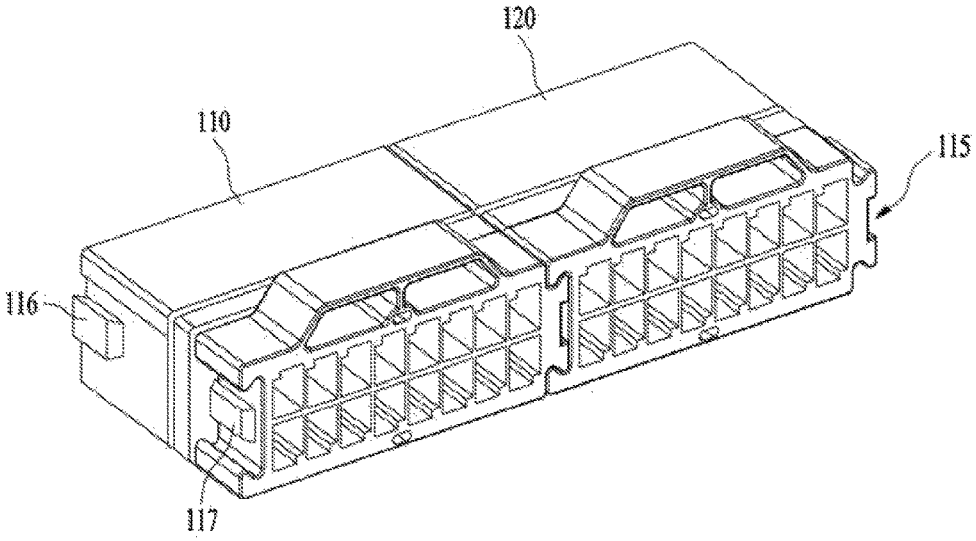

FIG. 1 is a perspective view illustrating a joint connector assembly in the state in which unit connector housings and a sliding cover are coupled to each other, and FIGS. 2A-2B are perspective views illustrating the process in which the unit connector housings depicted in FIG. 1 are coupled to each other when viewed from the front thereof.

Referring to FIGS. 1 and 2A-2B, a joint connector assembly 100 in one form of the present disclosure comprises a first unit connector housing 110, a second unit connector housing 120 coupled to the first unit connector housing 110, and a sliding cover 130, to which the first unit connector housing 110 and the second unit connector housing 120 are coupled in a sliding manner.

The first unit connector housing 110 has a predetermined number of first terminal holes 111 therein, which are configured as a female connector formed in a predetermined pattern so as to be connected to a male connector. The pattern of the first terminal holes 111 may be variously determined depending on the pattern of the male connector that is to be connected therewith.

The second unit connector housing 120 has a predetermined number of second terminal holes 121 therein, which are formed in a predetermined pattern. The first unit connector housing 110 and the second unit connector housing 120 may have different shapes from each other or may have the same shape as each other.

Figure 9:
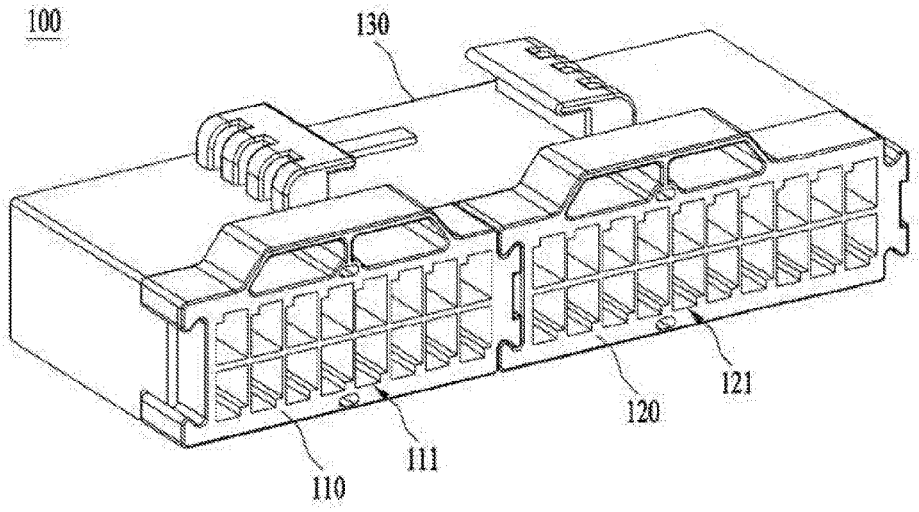
FIG. 9 is a perspective view illustrating that the number of first the number of first terminal holes in the first unit connector housing is different from the number of second terminal holes in the second unit connector housing in another form.

Referring to FIG. 9, in the case in which the first unit connector housing 110 and the second unit connector housing 120 have different shapes from each other, the number of first terminal holes 111 and the number of second terminal holes 121 are different. On the other hand, in the case in which the first unit connector housing 110 and the second unit connector housing 120 have the same shape as each other, the number of first terminal holes 111 and the number of second terminal holes 121 are identical.

Hereinafter, the form will be described with reference to the construction in which the first unit connector housing 110 and the second unit connector housing 120 have the same shape as each other; however, the construction in which the first unit connector housing 110 and the second unit connector housing 120 have different unit sizes from each other may also be included in the scope of the present disclosure.

The first unit connector housing 110 and the second unit connector housing 120 are expanded in the lateral direction by being coupled to each other in a sliding manner. To this end, each of the first unit connector housing 110 and the second unit connector housing 120 is provided with fastening members at a lateral surface thereof that is brought into contact with the adjacent lateral surface of the adjacent connector housing.

The fastening members include a first fastening block 112, which protrudes from any one of the first unit connector housing 110 and the second unit connector housing 120, and a first fastening recess 113, which is formed in the other one thereof and into which the first fastening block 112 is inserted.

The joint connector assembly 100 is constructed such that the first fastening block 112 protrudes from one lateral surface of the first unit connector housing 110 and the first fastening recess 113 is formed in one lateral surface of the second unit connector housing 120 that is oriented toward the first fastening block 112. Of course, the first fastening recess 113 is also formed in the opposite lateral surface of the first unit connector housing 110 at a position corresponding to the position of the first fastening block 112.

Since the first fastening block 112 and the first fastening recess 113 are coupled to each other in a sliding manner, the first unit connector housing 110 and the second unit connector housing 120 are coupled to each other in the lateral direction.

The first unit connector housing 110 further has a second fastening recess 115 formed in one lateral surface thereof, which is aligned with the first fastening block 112, and the second unit connector housing 120 is further provided with a second fastening block 116 at one lateral surface thereof, which is aligned with the first fastening recess 113. Of course, the second fastening block 116 is also provided at the opposite lateral surface of the first unit connector housing 110 at a position corresponding to the position of the second fastening recess 115. Further, since the first unit connector housing 110 and the second unit connector housing 120 have the same shape as each other, the second unit connector housing 120 also has the first fastening block 112 and the second fastening recess 115 in one of the two opposite lateral surfaces thereof and the first fastening recess 113 and the second fastening block 116 in the other lateral surface thereof.

The first fastening block 112 and the first fastening recess 113 are components that merely realize sliding coupling. In contrast, the second fastening block 116 and the second fastening recess 115 function to limit the sliding distance of the first unit connector housing 110 and the second unit connector housing 120 as well as to realize sliding coupling in the same manner as the first fastening block 112 and the first fastening recess 113.

The sliding distance of the first unit connector housing 110 and the second unit connector housing 120 is limited to such an extent that, when the first unit connector housing 110 and the second unit connector housing 120 are completely coupled to each other from the non-coupled state in FIG. 2A, the top surfaces of the first unit connector housing 110 and the second unit connector housing 120 are located in the same plane, or the first unit connector housing 110 and the second unit connector housing 120 are aligned with each other in the lateral direction, as shown in FIG. 2B.

The engagement between the first fastening block 112 and the first fastening recess 113 or the engagement between the second fastening block 116 and the second fastening recess 115 is achieved by the sliding movement in a first direction. On the other hand, the disengagement between the first fastening block 112 and the first fastening recess 113 or the disengagement between the second fastening block 116 and the second fastening recess 115 is achieved by the sliding movement in a second direction, which is opposite to the first direction.

Because the engagement cannot be achieved by the sliding movement in the second direction and the disengagement cannot be achieved by the sliding movement in the first direction, even when the unit connector housings are further expanded, for example, third, fourth and fifth unit connector housings (not shown) are additionally coupled to the assembly of the first unit connector housing 110 and the second unit connector housing 120, a user can recognize the direction in which each of the unit connector housings is engaged with or disengaged from the others.

The first unit connector housing 110, which has the first fastening block 112 and the second fastening recess 115 in one lateral surface thereof and the first fastening recess 113 and the second fastening block 116 in the opposite lateral surface thereof, and the second unit connector housing 120, which has the same structure as the first unit connector housing 110, are coupled to each other.

The fastening members further include a coupling recess 114, which is formed in the first fastening block 112 in the direction in which the first fastening block 112 is coupled to the first fastening recess 113 in a sliding manner, and a coupling protrusion 117, which protrudes from the first fastening recess 113 toward the coupling recess 114 so as to interlock with the coupling recess 114.

Therefore, when the first fastening block 112 and the first fastening recess 113 are coupled to each other in a sliding manner, the coupling protrusion 117 interlocks with the coupling recess 114, which inhibits or prevents the first unit connector housing 110 and the second unit connector housing 120 from being disengaged from each other in a sliding manner.

Further, such a fastening mechanism provides the configuration that the first unit connector housing 110 and the second unit connector housing 120 or further unit connector housings are evenly connected in the lateral direction such that the top surfaces of all unit connector housings are located in the same plane.

Figure 3:
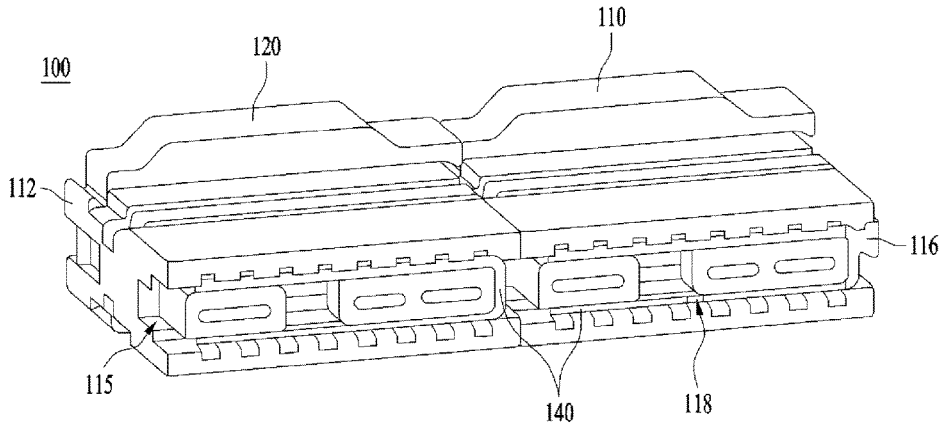
FIG. 3 is a perspective view illustrating the state in which the unit connector housings depicted in FIG. 2 are coupled to each other when viewed from the rear thereof.
Figure 4:
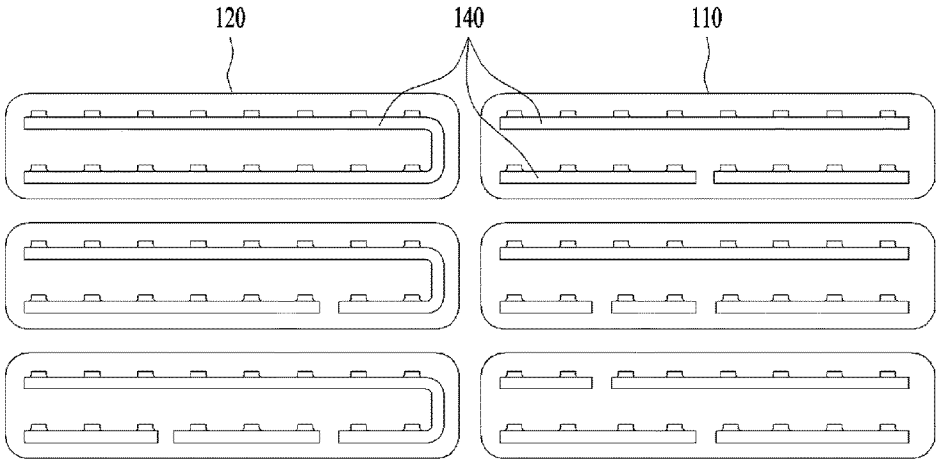
FIG. 4 is a reference view illustrating various patterns of joint bus bars that are coupled to rear surfaces of the unit connector housings depicted in FIG. 3.

FIG. 3 is a perspective view illustrating the state in which the unit connector housings depicted in FIG. 2 are coupled to each other when viewed from the rear thereof, FIG. 4 is a reference view illustrating various patterns of joint bus bars that are coupled to rear surfaces of the unit connector housings depicted in FIG. 3, and FIG. 5 is a reference view illustrating the state in which the unit connector housings depicted in FIG. 3 are coupled to the sliding cover.

Referring to FIGS. 3 to 5B, a joint bus bar 140 is coupled to the rear surface of each of the first unit connector housing 110 and the second unit connector housing 120 so as to connect the terminals provided in the first terminal holes 111 to each other or the terminals provided in the second terminal holes 121 to each other in a predetermined pattern.

Each of the first unit connector housing 110 and the second unit connector housing 120 has a bus bar recess 118 formed in the rear surface thereof, in which the joint bus bar 140 is fitted.

The joint bus bar 140 functions to combine the terminals into one corresponding to a single circuit or to group the terminals to correspond to a plurality of circuits so that the terminals are appropriately distributed to the respective circuits. Further, the joint bus bar 140 is coupled to the bus bar recess 118 in a sliding manner and electrically connects predetermined terminals to each other.

Referring to FIG. 3, the joint bus bar 140, which is coupled to the rear surface of the first unit connector housing 110, is divided into an upper portion and a lower portion, and the lower portion is further divided into a left portion and a right portion. The terminals provided in the first terminal holes 111 are grouped and electrically connected to each other to correspond to three circuits so as to distribute the current to the three circuits.

The joint bus bar 140, which is coupled to the rear surface of the second unit connector housing 120, is formed in a unitary body, with the result that all of the terminals provided in the second terminal holes 121 are electrically connected to form a single circuit.

FIG. 4 exemplarily illustrates some forms in which 16 terminals are electrically combined to form a single circuit or are electrically connected in groups to form multiple respective circuits. Of course, it is possible to electrically connect 16 terminals in groups to realize various other circuit patterns.

Although not illustrated in the drawings, the first unit connector housing 110 and the second unit connector housing 120 may be regarded as a unitary connector housing, and the joint bus bar 140 may be configured to electrically connect the terminals of the first and second unit connector housings 110 and 120 together without division between the first unit connector housing 110 and the second unit connector housing 120. In this case, the sum of the number of terminal holes formed in the first and second unit connector housings 110 and 120 may be 32, and the joint bus bar 140 may combine all of the terminals provided in the 32 terminal holes so as to form a single circuit, or may electrically connect the terminals in groups to form a plurality of circuits.

Figure 5A:
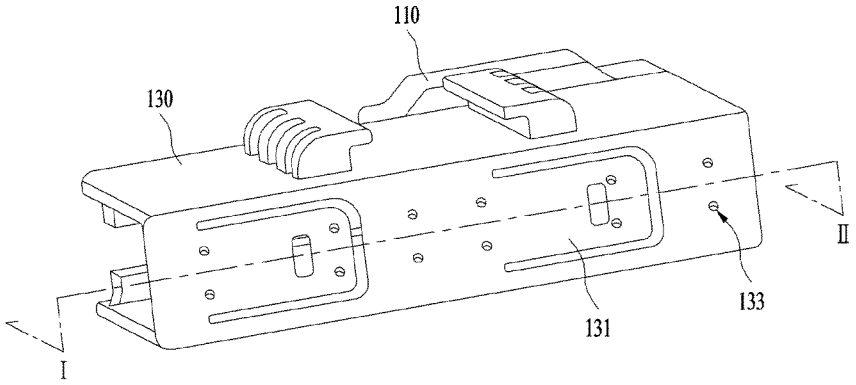
FIGS. 5A-5B are reference views illustrating the state in which the unit connector housings depicted in FIG. 3 are coupled to the sliding cover.

After the first unit connector housing 110 and the second unit connector housing 120 are coupled to each other and the joint bus bar 140 is coupled to the rear surface of each of the first unit connector housing 110 and the second unit connector housing 120 in a predetermined pattern, the assembly of the first unit connector housing 110 and the second unit connector housing 120 is coupled to the sliding cover 130, as shown in FIG. 5A.

FIG. 5A illustrates the construction in which only the first unit connector housing 110 is coupled to the sliding cover 130. The construction in which either the first unit connector housing 110 or the second unit connector housing 120 is separately coupled to the sliding cover 130 will be explained later.

Referring to FIG. 5A, the sliding cover 130 is provided with a resilient portion 131 at the rear surface thereof, which is formed by cutting a portion of the rear surface of the sliding cover 130 so as to have resilience.

When the first unit connector housing 110 or the second unit connector housing 120 is removed from the sliding cover 130, the resilient portion 131 functions to resiliently release the interlocking engagement between the sliding cover 130 and the first unit connector housing 110 or the second unit connector housing 120.

In addition, the sliding cover 130 has a plurality of inspection holes 133 formed in the rear surface thereof so as to permit inspection of the circuit pattern of the joint bus bar 140 coupled to the rear surface of each of the first unit connector housing 110 and the second unit connector housing 120.

The inspection holes 133 may be formed at positions corresponding to the positions of respective terminal holes or may be formed at positions corresponding to the positions of respective divided sections of the joint bus bar 140. Further, the inspection holes 133 may be formed in the resilient portion 131 or may be formed in areas other than the resilient portion 131 in the rear surface of the sliding cover 130.

Figure 5B:
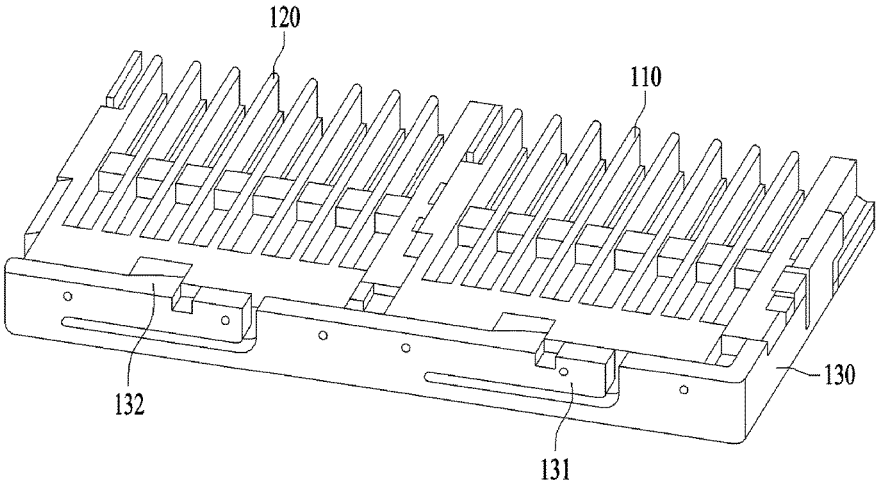

FIG. 5B illustrates a section of the assembly in which the first unit connector housing and the second unit connector housing are completely coupled to the sliding cover, which is taken along line I-II in FIG. 5A.

As shown in FIG. 5B, a protruding portion 132 is provided at the inner surface of the resilient portion 131. The protruding portion 132 functions to interlock with the rear surface of the first unit connector housing 110 or the second unit connector housing 120, thereby inhibiting or preventing the first unit connector housing 110 or the second unit connector housing 120 from being separated from the sliding cover 130.

It is possible to remove the first unit connector housing 110 or the second unit connector housing 120 from the sliding cover 130 by resiliently deforming the resilient portion 131 so as to release the interlocking engagement between the protruding portion 132 and the first unit connector housing 110 or the second unit connector housing 120.

Figure 6:
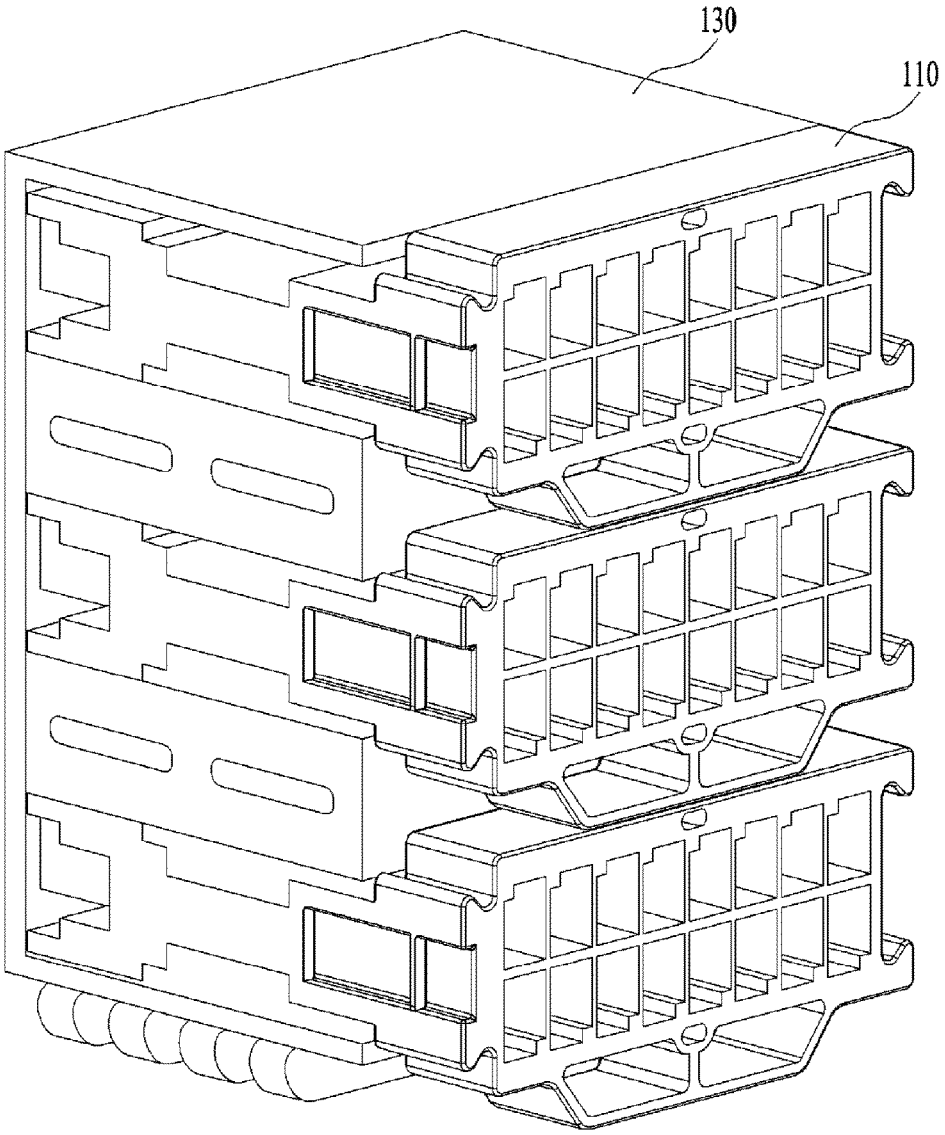
FIGS. 6 and 7 are reference views illustrating the state in which the unit connector housings are coupled to various types of sliding covers so as to be stacked in a lateral direction or in a vertical direction.
Figure 7:
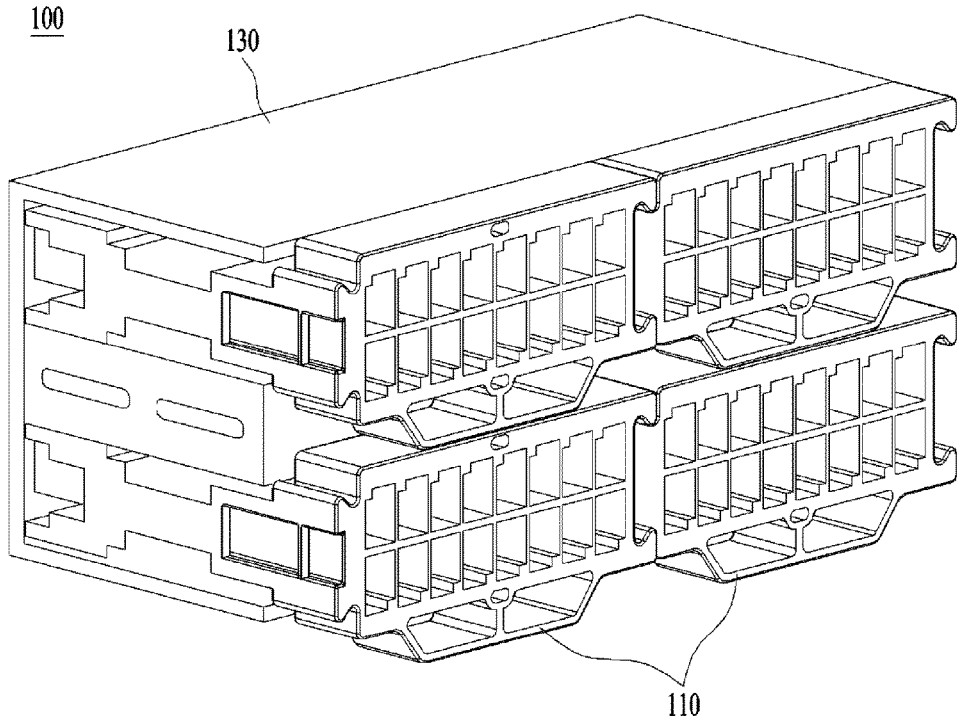

FIGS. 6 and 7 are reference views illustrating the state in which the unit connector housings are coupled to various types of sliding covers so as to be stacked in the lateral direction or in the vertical direction.

The joint connector assembly 100 depicted in FIG. 6 is constructed such that the first unit connector housings 110 are coupled to the sliding cover 130, in which the first unit connector housings 110 are stacked in the vertical direction. In this case, each of the first unit connector housings 110 is independently coupled to the sliding cover 130 without being coupled with the second unit connector housing 120 in the lateral direction. Although it is illustrated in FIG. 6 that the first unit connector housings 110 are stacked so as to form three layers in the vertical direction, the form is not limited thereto, and the assembly of the first unit connector housings may be further expanded in the vertical direction.

The joint connector assembly 100 depicted in FIG. 7 is constructed such that the first unit connector housings 110 and the second unit connector housings 120 are coupled to the sliding cover 130, in which multi-layers of assemblies, each including the first unit connector housing 110 and the second unit connector housing 120 coupled to each other in the lateral direction, are stacked in the vertical direction. In this case, the first unit connector housings 110 and the second unit connector housings 120 are arranged in an approximate lattice shape such that they are expanded in both the lateral direction and the vertical direction. Such a lattice-type joint connector assembly is more efficient in space utilization than the joint connector assembly in which unit connector housings are arranged only in one direction.

Figure 8:
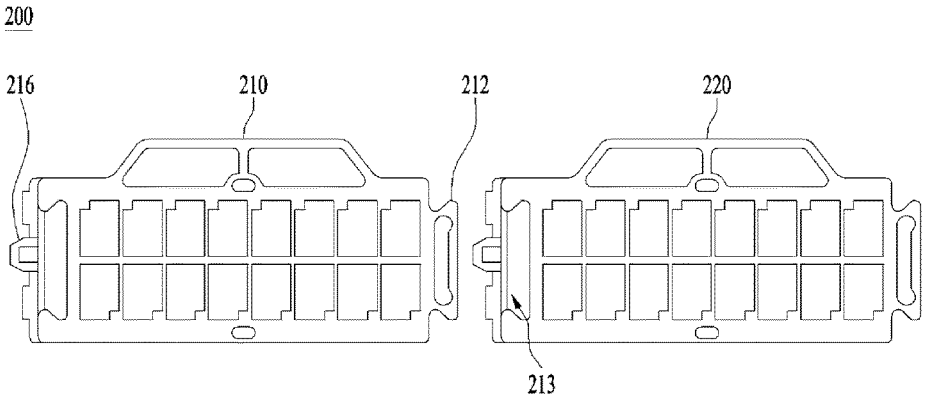
FIG. 8 is a front view illustrating the process in which unit connector housings are coupled to each other.

FIG. 8 is a front view illustrating the process in which unit connector housings in another form of the present disclosure are coupled to each other. Hereinafter, reference numerals the same as those described above designate the same constituent elements.

Referring to FIG. 8, a joint connector assembly 200 in another form of the present disclosure has a difference in that a first unit connector housing 210 and a second unit connector housing 220 are coupled to each other in the lateral direction in a press-fit manner.

The first unit connector housing 210 is first coupled to the sliding cover 130. Subsequently, the second unit connector housing 220 is coupled to the sliding cover 130, and is simultaneously coupled to the first unit connector housing 210, leading to improved assembly efficiency.

Similar to the previous form, the first unit connector housing 210 and the second unit connector housing 220 in this form are provided with a first fastening block 212, a first fastening recess 213, in which the first fastening block 212 is press-fitted, a second fastening block 216, and a second fastening recess (not shown), in which the second fastening block 216 is press-fitted. The first unit connector housing 210 and the second unit connector housing 220 are coupled to the sliding cover (not shown) in a sliding manner.

As described above, it is possible to produce joint connector assemblies suitable for various circuit patterns merely by connecting unit connector housings, each having a unit size, to each other, thereby reducing manufacturing costs and further reducing development costs.

As is apparent from the above description, a joint connector assembly of the present disclosure has the following advantages.

First, the joint connector assembly may be easily modified so as to satisfy a desired number of circuits merely by coupling a plurality of unit connector housings to a sliding cover.

Second, since engagement between the unit connector housings or engagement between the unit connector housing and the sliding cover is easily achieved, it is possible to provide an integral-type joint connector assembly.

Third, since the unit connector housings can be connected to each other in the lateral direction or can be stacked in the vertical direction, the direction in which the unit connector housings are expanded may be selectively determined in consideration of the installation conditions.

Finally, since only one kind of unit connector housing is employed, it is possible to reduce manufacturing costs and development costs and to facilitate quality control.

It will be apparent to those skilled in the art that various modifications and variations can be made in the present disclosure without departing from the spirit or scope of the present disclosure. Thus, it is intended that the present disclosure covers the modifications and variations of the present disclosure.

What is claimed is:

1. A joint connector assembly comprising:

a first unit connector housing having a predetermined number of first terminal holes formed therethrough in a predetermined pattern;

a second unit connector housing configured to be connected to the first unit connector housing and having a predetermined number of second terminal holes formed therethrough in a predetermined pattern; and a sliding cover configured to allow the first unit connector housing and the second unit connector housing to be coupled to the sliding cover in a sliding manner, wherein an arrangement direction of the first terminal holes formed in the first unit connector housing is parallel to an arrangement direction of the second terminal holes in the second unit connector housing, wherein a lateral surface of the first unit connector housing directly contacts with a lateral surface of the second unit connector housing, and the first and second terminal holes are not communicated to each other, and wherein the number of first terminal holes in the first unit connector housing is different from the number of second terminal holes in the second unit connector housing.

2. The joint connector assembly according to claim 1, wherein the first unit connector housing and the second unit connector housing have a same shape as each other.

3. The joint connector assembly according to claim 1, further comprising:

fastening members provided at the lateral surfaces of the first unit connector housing and the second unit connector housing that are configured to contact to each other when the first unit connector housing and the second unit connector housing are connected to each other.

4. The joint connector assembly according to claim 3, wherein the fastening members include:

a first fastening block protruding from the lateral surface of any one of the first unit connector housing and the second unit connector housing; and a first fastening recess formed in the lateral surface of a remaining one of the first unit connector housing and the second unit connector housing, the first fastening recess configured to receive the first fastening block therein so as to be engaged with the first fastening block.

5. The joint connector assembly according to claim 4, wherein the fastening members further include:

a second fastening block provided so as to be aligned with the first fastening recess; and a second fastening recess formed so as to be aligned with the first fastening block and configured to receive the second fastening block therein so as to be engaged with the second fastening block.

6. The joint connector assembly according to claim 5, wherein the first fastening block and the first fastening recess are coupled to each other in a sliding manner, or the second fastening block and the second fastening recess are coupled to each other in a sliding manner.

7. The joint connector assembly according to claim 6, wherein engagement between the first fastening block and the first fastening recess or engagement between the second fastening block and the second fastening recess is achieved by sliding movement in one direction and is released by sliding movement in an opposite direction.

8. The joint connector assembly according to claim 6, wherein the fastening members further include:

a coupling recess formed in the first fastening block in a direction in which the first fastening block is coupled to the first fastening recess in the sliding manner; and a coupling protrusion protruding from the first fastening recess toward the coupling recess so as to interlock with the coupling recess.

9. The joint connector assembly according to claim 5, wherein the first fastening block and the first fastening recess are coupled to each other in a press-fit manner, or the second fastening block and the second fastening recess are coupled to each other in a press-fit manner.

10. The joint connector assembly according to claim 1, wherein the first unit connector housing or the second unit connector housing includes:

a joint bus bar for connecting terminals provided in the first terminal holes to each other or terminals provided in the second terminal holes to each other in a predetermined pattern; and a bus bar recess formed in a rear surface of the first unit connector housing or the second unit connector housing and configured to receive the joint bus bar therein.

11. The joint connector assembly according to claim 10, wherein the sliding cover has a plurality of inspection holes formed in a rear surface thereof so as to permit inspection of a circuit pattern of the joint bus bar when engagement between the first unit connector housing and the second unit connector housing has been completed.

12. The joint connector assembly according to claim 1, wherein the sliding cover is provided with a protruding portion at an inner rear surface thereof, the protruding portion configured to interlock with the first unit connector housing or the second unit connector housing so as to inhibit the first unit connector housing or the second unit connector housing from being separated from the sliding cover.

13. The joint connector assembly according to claim 12, wherein the sliding cover is provided with a resilient portion configured to resiliently support the protruding portion so as to release interlocking engagement between the protruding portion and the first unit connector housing or the second unit connector housing when the first unit connector housing or the second unit connector housing is removed from the sliding cover.

* * * * *